US005460230A

United States Patent [19]

Dekoster

[11] Patent Number: 5,460,230

[45] Date of Patent: Oct. 24, 1995

[54] CORE BIT

[75] Inventor: Claude Dekoster, Brussels, Belgium

[73] Assignee: Baroid Technology, Inc., Houston, Tex.

[21] Appl. No.: 199,243

[22] PCT Filed: Aug. 28, 1992

[86] PCT No.: PCT/BE92/00035

§ 371 Date: May 16, 1994

§ 102(e) Date: May 16, 1994

[87] PCT Pub. No.: WO93/05264

PCT Pub. Date: Mar. 18, 1993

[30] Foreign Application Priority Data

Aug. 28, 1991 [BE] Belgium ..... 09100800

[51] Int. Cl.[6] ..... E21B 10/02; E21B 10/60

[52] U.S. Cl. ..... 175/58; 175/393; 175/405.1

[58] Field of Search ..... 175/405.1, 403, 175/393, 58, 246, 248

[56] References Cited

U.S. PATENT DOCUMENTS

| | | | |
|---|---|---|---|
| 1,663,025 | 3/1928 | Phipps . | |
| 2,264,617 | 12/1941 | Carpenter et al. . | |
| 3,095,935 | 7/1963 | Hildebrandt et al. | 175/405.1 |
| 3,215,215 | 11/1965 | Kellner | 175/393 X |
| 3,322,218 | 5/1967 | Hilderbrant | 175/405.1 |
| 3,565,192 | 2/1971 | McLarty | 175/246 |

FOREIGN PATENT DOCUMENTS

| | | | |
|---|---|---|---|
| 212809 | 3/1987 | European Pat. Off. . | |
| 356657 | 3/1990 | European Pat. Off. . | |
| 43533 | 9/1960 | Poland | 175/246 |
| 791890 | 12/1980 | U.S.S.R. | 175/403 |
| 825833 | 4/1981 | U.S.S.R. | 175/393 |
| 838570 | 6/1960 | United Kingdom . | |
| 2085945 | 5/1982 | United Kingdom . | |

*Primary Examiner*—Hoang C. Dang

*Attorney, Agent, or Firm*—Browning, Bushman, Anderson and Brookhart

[57] ABSTRACT

The present invention discloses a core bit comprised of a body having blades thereon, with several cutters on each blade, and nozzles that emerge on the face of the body. The nozzles deflect liquids substantially obliquely with respect to an axis of rotation of the body, preferably according to an angle greater than 45°. The nozzle defines an elbow portion formed from a molded portion of the body and from an insert opposite said molded portion on the side of the largest curvature of radius of the elbow. An inner hollow core retaining element includes an axial annular lip to engage an annular groove in the body. The annular lip and groove define a passage gap to regulate coring liquid flow therethrough. An inner portion between the blades has a cross-section with a curve having a most forward point adjacent the core, the curve having a first convex portion from the forward point to adjacent the insert and a second convex portion extending laterally outwardly.

16 Claims, 3 Drawing Sheets

CORE BIT

The present invention relates to a core bit, in particular for a reservoir evaluation coring, comprising:

a body which is rotatable around a rotation axis, blades provided onto the body at least in front of this body, several cutters divided along each blade and having each a cutting edge, the cutting edges being circumscribed together within an imaginary envelope disposed around a core to be taken, nozzles which supply a jet of coring liquid and which emerge at the face of the body.

Core bits of the hereabove defined type are already known. The nozzles therein are formed by bored rectilinear outlets.

An important problem, particularly in the case of the above mentioned evaluation coring, consists in reducing as much as possible the washing of the core during the coring operation, as well at the cutting place as within the bit. The washing can cause for example coring liquid to penetrate into the core to the detriment of various fluids which are contained therein before the coring operation, which may contaminate the core in such a manner that the evaluation of a subsoil as to its capacities for serving as a reservoir or as to its content of searched products becomes impossible. However, the bottom of the groove cut by the bit around the core, has always to be provided with coring liquid, in order to cool the elements which are heated due to friction and in order to evacuate the fragments released during the coring so as to assure an efficient cleaning of the bit and the bottom of the groove.

An object of the invention is to solve this problem by acting upon factors which influence the contact between the coring liquid and the core while assuring a sufficient flow rate of said liquid in order that it fulfils its essential functions which are known by the man skilled in the art.

A factor influencing said contact of coring liquid concerns the orientation of this liquid with respect to the core in formation.

To this end, at least one nozzle has, according to the invention, an outlet deflecting the liquid jet substantially obliquely forwards with respect to the rotation axis of the body, away from the core, preferably according to an angle larger than 45°, and advantageously larger than 50°.

Advantageously, the invention provides that the deflected nozzle emerges between two blades in a manner such as to create a detachment effect of a stream of coring liquid situated near the core and/or the bit.

In this way, the coring liquid is removed very quickly from the core and, as it cannot stagnate close to the latter, does not contaminate the core. Moreover, due to the detachment effect, the liquid pressure is locally low, in particular near the core, and this liquid is not pressed into the core but may possibly simply cover it with a protective layer which can prevent liquids contained in the core from escaping and that consequently wrong evaluations would be made. The liquid pressure is advantageously adjusted to avoid an extraction of liquids contained in the core.

In a very advantageous embodiment of the invention, the nozzle comprises at least one inserted piece for realizing the deflection, the inserted piece being preferably made of a material having a higher abrasion resistance than the material of the bit, and is advantageously made of sintered carbide.

From the point of view of the users costs, it is advantageous to make the place acted upon by the deflecting coring liquid separately from the body in such a manner that this place can be replaced in the case of wear without having to replace the entire bit or to recondition it thoroughly. It is still more advantageous to make this place in a manner such as to prolong its life. Moreover, the use of an inserted piece allows to remove it in order to make for example a cleaning of the corresponding nozzle easier.

In a preferred embodiment of the invention, an inner hollow core retaining element, which is supported by a string of rods to which the bit is attached, is associated with the bit, in such a manner that a passage gap for letting coring fluid through is formed with respect to this bit substantially around the core, preferably near the cutters, the flow rate of liquid through the passage gap being smaller than 25% of the total flow rate of liquid flowing out through this passage gap and through said nozzles. Moreover, in a particularly preferred way, the flow rate of liquid through the passage gap is equal to or smaller than 10% of said total flow rate, advantageously equal to or smaller than 5% of the latter.

According to a particularly preferred embodiment of the invention, the inner hollow element is substantially cylindrical and has a substantially axial annular front lip, and the body has an annular groove wherein the front lip projects substantially coaxially in such a manner that said passage gap for letting the coring liquid supplied through a space between the bit body and the inner element through, has in a section according to a plane going through the rotation axis substantially a U-shape. Advantageously, the front lip is connected to the inner element in such a manner that an annular collar is formed, which is situated on the inside of the inner element and which faces an inner edge of the annular groove, the surfaces opposite the annular collar and the inner edge being flat and disposed at right angles to the rotation axis. Advantageously, a passage distance, according to the rotation axis, between the front extremity of the front lip and the bottom of the annular groove is smaller than 12 mm, preferably smaller than 9 mm and advantageously at the most equal to 8 mm, and is in particular at least equal to 5 mm.

According to another more particularly preferred embodiment of the invention, the cutters are provided in such a manner onto the blades that the envelope comprises, in a plane including the rotation axis, with respect to the coring direction, a forward top and a backwards inclined curvature which extends away from the top in the direction opposite to the rotation axis, the curvature having a portion, located at least near the top, the inclination of which is weak with respect to a perpendicular to the rotation axis in said plane. In a very advantageous way, said curvature starts at the top itself. Moreover, said curvature may comprise preferably after said weakly inclined portion, outwards with respect to the top, a portion of a more accentuated inclination where the tangent to the envelope may become substantially parallel to the rotation axis.

According to another very advantageous embodiment, the invention provides that the envelope comprises, moreover, in the plane including the rotation axis, another backwards inclined curvature which extends away from the top towards the rotation axis, the other curvature having a portion, at least near the top, the inclination of which is weak with respect to said perpendicular to the rotation axis.

According to another particularly preferred embodiment of the invention, a cutter which is the farthest removed from the rotation axis has moreover another cutting edge which is substantially parallel to the rotation axis. More particularly advantageously, a cutter which is situated the nearest to the rotation axis has moreover an additional cutting edge which is substantially parallel to the rotation axis.

According to a particularly advantageous embodiment of the invention, a portion of the surface of the front side of the bit, comprised between two successive blades, forms in a section according to a plane going through the rotation axis a curve, the most forward point of which is situated in the immediate vicinity of the core, the curve extending generally progressively backward in a convex way, as the distance to the core increases, so as to be connected to the outer lateral face of the body, the curve comprising advantageously at least two inflections so as to form a concave portion, preferably between the core and the outlet of the corresponding nozzle, a tangent to the bottom of which is substantially perpendicular to the rotation axis.

Other details and particularities of the invention will become apparent from the description of the drawings which are annexed to the present text and which illustrate, by way of non-limitative examples, a particular embodiment of the bit according to the invention.

In the different figures, the same reference numerals indicate identical or analogous elements.

Figure 1:
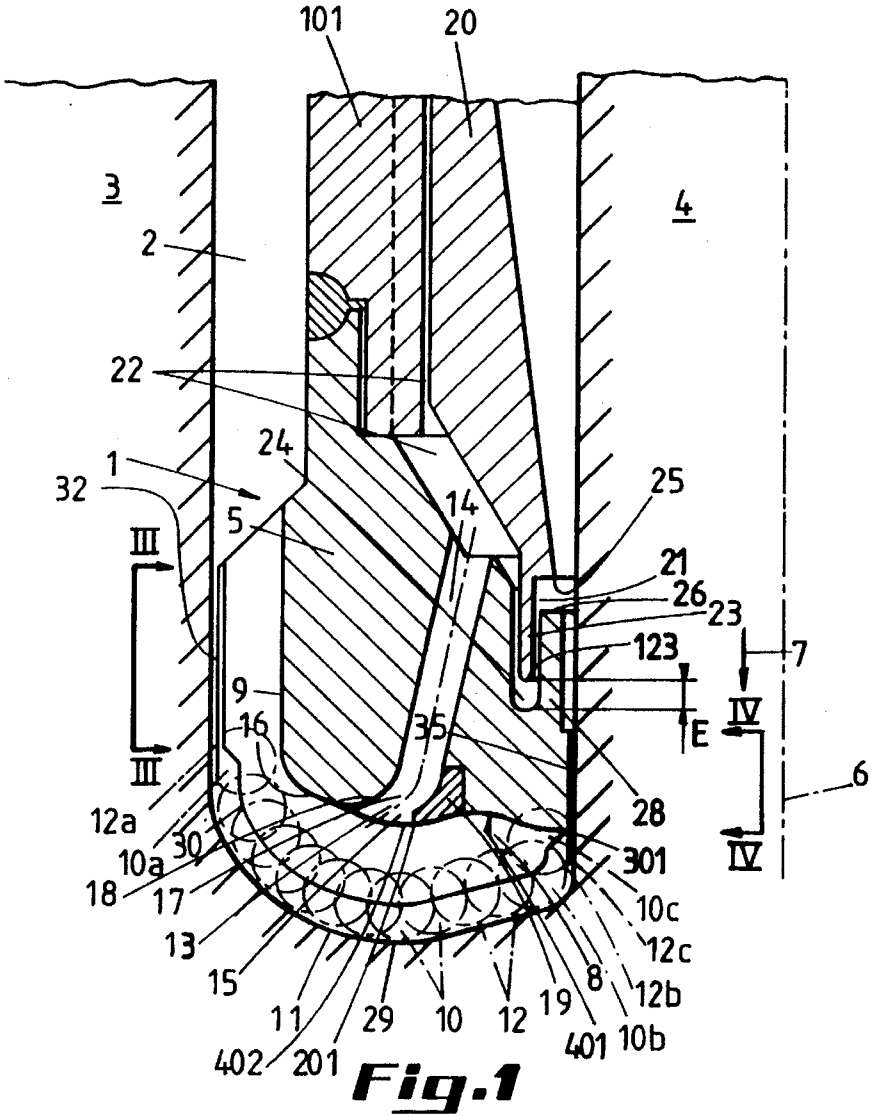
FIG. 1 shows a partially elevational and a partially sectional view of a bit according to the invention, advantageously provided with an inner core retaining element.

A core bit 1 is represented by way of example in FIG. 1 in a core hole 2 formed within a formation to be prospected 3. A core 4 is shown in the bit 1. For the clarity of the drawing of FIG. 1, the lines delimiting the outer elements of the bit 1 have been drawn spaced from the corresponding lines of the hole 2 of the core 4.

The bit 1 comprises a connector 101 through which it is commonly connected to a core pipe which is not represented and which is a part of a string of core rods and pipes known by the man skilled in the art.

The bit 1 comprises a body 5 which can commonly be made by moulding a carbide powder mixed with a binder having a low melting point and by heating in a graphite mould. The so-formed body has a rotation axis 6.

Figure 2:
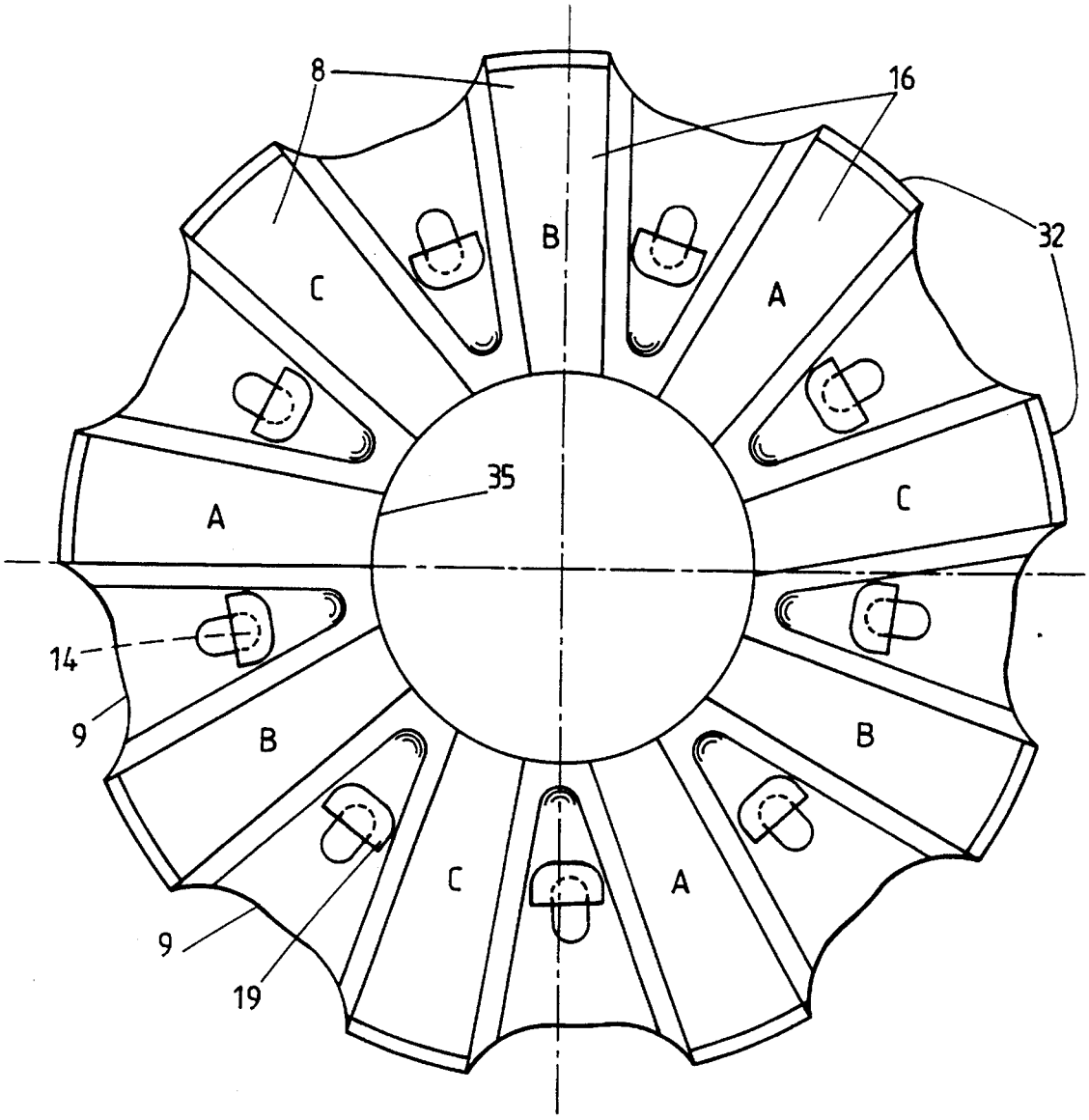
FIG. 2 shows a plan view, taken from underneath, of the bit according to FIG. 1.

Onto a front face according to a coring direction 7, parallel to the rotation axis 6, there are provided forwards projecting blades 8 which may extend, also radially projecting, along the outer lateral face 9 of the body 5 (see also FIG. 2). Onto each blade, there are fixed, for example in a known manner, cutters 10 (reference 10 comprising hereinafter also 10*a*, 10*b*, 10*c*) known per se and represented in FIG. 1 by circles. The blades 8, nine in FIG. 2, may all be similar as to their general configuration.

In the case of the bit 1 illustrated by way of example in FIG. 2, there are three groups of three blades 8 marked each by A, B, C, the difference between two blades 8 marked A, B or C arising from the position of the cutters 10 thereon. In each group of three blades A, B, C, the cutters 10 can be disposed on their respective blade 8 in such a manner that a cutter 10 is shifted radially outwards with respect to a cutter 10 of the preceding blade 8, according to the rotation direction of the coring, and radially inwards with respect to a cutter 10 of the following blade 8.

In order to visualize the shape of the bottom 11 of the hole 2, the superimposed projection of three blades A, B, C of a same group in the plane of the elevational transverse section of the body 5 is usually represented, as shown in FIG. 1. This superimposed projection shows thus the real cut transverse section, cut during the coring in the bottom 11 of the hole by the cutters 10 of a group of blades A, B, C. This transverse section corresponds to the transverse section, in a plane comprising the rotation axis 6, of an imaginary envelope formed around the core 4 along the cutting edges 12 of the cutters 10 rotating around the axis 6. The three groups of blades A, B, C can be mutually identical.

The body 5 has moreover nozzles 13 for providing said coring liquid to the bottom 11 of the hole. These nozzles 13 are each formed by a usual boring 14 which ends, according to the invention, by at least one outlet 15 curved away from the core 4 with respect to the axis of the boring 14. The boring 14 itself can already be relatively strongly inclined away from the core 4 in the discharge direction of the coring liquid, but a deflection of the outlet of 50° to 65° with respect to the rotation axis, which may appear to be particularly advantageous, can only be obtained in a reliable and little expensive way by the solution proposed further hereinafter. This important deflection is aimed at in order to avoid for example a disturbing washing of the core 4 at a place where it is made free from the formation by the cutters 10.

The outlets 15 are preferably provided between two blades 8 in such a manner that they form with the spaces delimited each time by two successive blades 8, by a surface portion of the front side, according to the coring direction, of the body 16 comprised between the two successive blades 8 and by the bottom 11 of the hole 2, a detachment effect of a stream of coring liquid situated near the core 4 and/or the bit 1. The orientation of the deflected outlet 15 can act therefore in a manner such as to exhaust for example the coring liquid situated near the core 4 and to propel it towards the beginning of the core hole 2, along the lateral outer surface 9, between the extended blades 8.

The deflected outlet 15 is advantageously made in the form of an elbow 17 directed away from the core 4. According to the invention, the elbow 17 is for example moulded in respect of its portion 18 situated on the side of its curvature centre and is formed by an inserted piece 19 in respect of its complementary portion situated on the side of the largest curvature radius of the elbow. This inserted piece 19, which gives to the coring liquid its deflected orientation, is preferably made of a material, the abrasion resistance of which is higher than the resistance of the material of the body 5. A sintered carbide appears to be very advantageous to this end. The inserted piece 19 is fixed onto the body 5, preferably in a corresponding recess in the body 5, in a way known by the man skilled in the art, for example by brazing it onto the bit body 5. In this way, the inserted piece may possibly be removed afterwards for a replacement, a cleaning, etc.

Within the bit 1, there is situated coaxially to this bit, an inner device, known per se, destined to retain the core 4 for bringing it to the surface. The inner device is supported by the string of rods and may comprise an inner hollow element 20 which is coaxial to the bit 1 to form a passage gap 21 for letting coring fluid through, which gap is advantageously annular around the core 4 and situated-near the cutters 10 in order that the coring liquid fulfils there its function which is known per se. The coring liquid is preferably brought as far as possible near the bottom 11 of the hole 2, spaced from the core 4 in order to prevent contamination of this core and, in this way, deformation of the information which can be derived from a core. For this reason, the coring liquid can be brought down to the passage gap 21 through an annular space 22 between, on the one hand, the coring pipe (not shown) or the body 5 and, on the other hand, the inner hollow element 20.

The inner hollow element 20 comprises advantageously an annular front lip 23 with respect to the coring direction which extends this element for example in the axial direction and which penetrates into an annular groove 24 provided in the body 5. This annular groove 24 extends for example axially in a manner such as to form, through an appropriate spacing between the inner faces of this groove and the lateral faces of the front lip 23, said passage gap 21. Preferably, the front lip extends the inner hollow element 20 while leaving a collar surface 25 which may be flat and which may extend substantially at right angles to the rotation axis 6, towards the latter within the inner hollow element 20. At a predetermined distance from this collar surface 25, there is for example an inner edge 26 which can be flat and parallel to this collar and which forms the top of the inner side 28 of the annular groove 24.

Between the circular ridge 123 of the front side of the front lip 23 and the bottom of the annular groove 24, there is a distance E which is equal to said predetermined distance in order to make the measurements easier.

Figure 5:
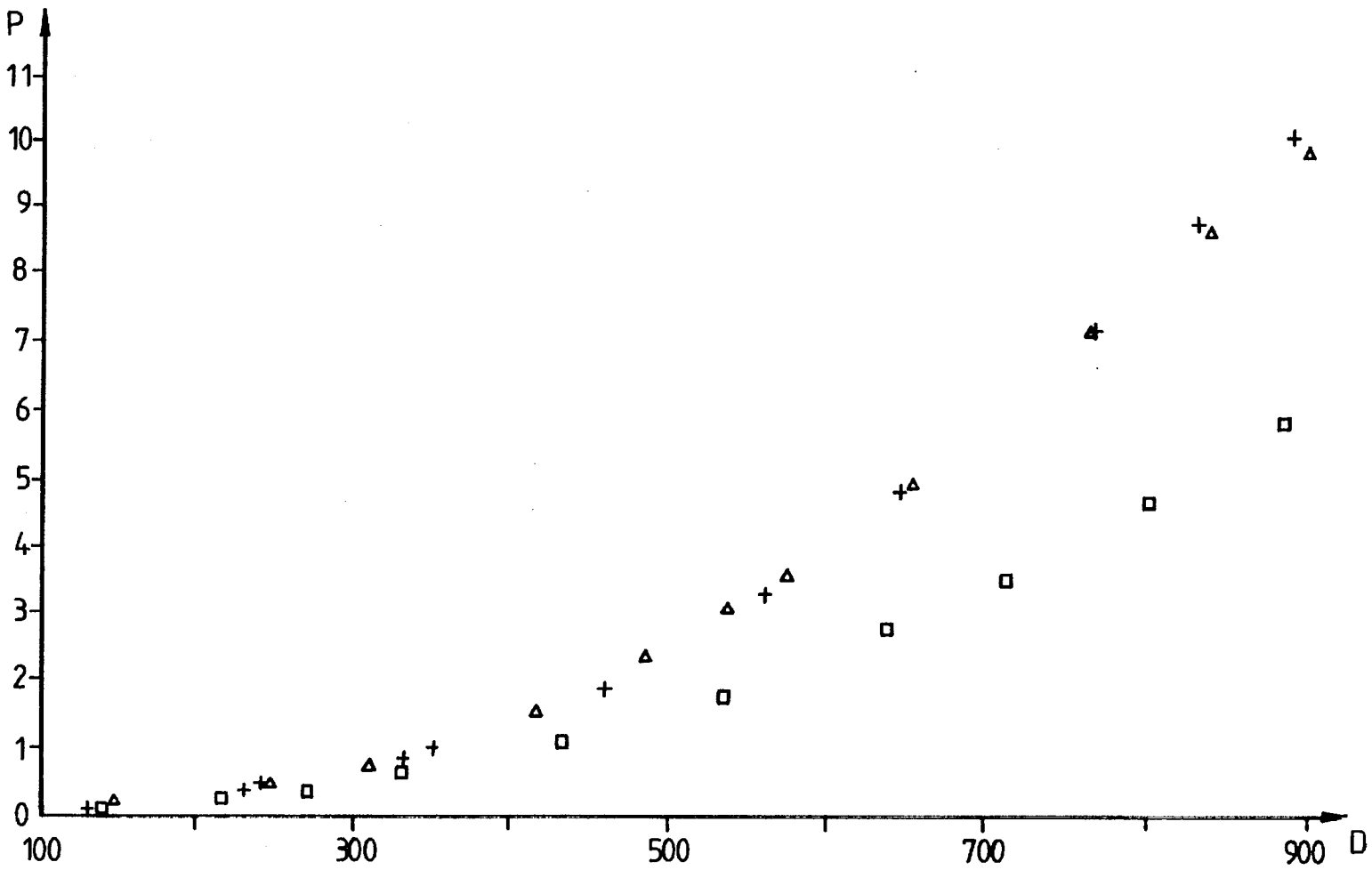
FIG. 5 is a graph of the coring liquid pressure difference before and after a passage gap, in function of the flow rate of said liquid and of said passage distance.

The distance E can for example be chosen in a manner such as to obtain, in function of the flow rate of the coring liquid and for a given configuration of the annular groove 24 and the front lip 23, an important pressure difference between the coring liquid before and after the passage gap 21 so as to enhance said stream detachment effect. FIG. 5 shows by way of example a graph obtained by experiments and formed of points giving curves of the difference in coring liquid pressure P (in bars) in function of the flow rate D (in liters/min) of this liquid and in function of the different distances E in mm. It can be noticed that for a distance E of 14.2 mm (see the curve suggested by the square measurement points: □), the pressure difference P increases relatively weakly in function of an increase of the flow rate D whereas, all other things being identical, starting from a distance E of 8 mm (cross-shaped measurement point: +), the increase of the pressure difference P is the most sensitive. However, for any value of E lower than 8 mm, for example for E=3 mm (triangular measurement point:), it can be seen that the corresponding curve is substantially not spaced from the curve established for E=8 mm. It appears therefore that a minimum value for the distance E comprises 5 mm.

According to the invention, the front lip 23 and the annular groove 24, on the one hand, and the whole of the nozzles 13, on the other hand, can be adapted advantageously by adjusting the distance E, in such a manner that the flow rate of coring liquid through the passage gap 21 is lower than 25% of the total flow rate of this liquid flowing as well through the gap 21 as through all the nozzles 13. It is more over very advantageous that this flow rate is smaller than 5% of the total flow rate.

The bit of FIG. 1, which illustrates the invention by way of example, is realized on the front side according to the coring direction in such a manner that said section through the envelope of the cutting edges 12 comprises advantageously a forward top 29 and, for example, starting from this top 29 a curvature which is the more inclined towards the back of the bit 1 as the distance from the top 29 and also from the rotation axis 6 increases. This curvature comprises, as shown for example in FIG. 1, near the top 29 over an important portion, an inclination with respect to a perpendicular to the rotation axis comprises in the plane of the section, which inclination is very weak with respect to a usual bit inclination.

Since the blades 8 can extend along the lateral outer surface 9, it is advantageous that the cutters 10 are disposed, along a first extended portion 30 of at least one blade 8, in such a manner that said curvature becomes practically parallel to the rotation axis 6. Preferably, the cutter **10*a* which is the farthest removed from the rotation axis 6 in a group of blades A, B, C, can present then another cutting edge 12*a* which is parallel to this rotation axis 6, outside the bit 1, in order to form a hole 2 which is as coaxial as possible to the core 4** in order to subject this core to the smallest possible radial forces.

Figure 3:
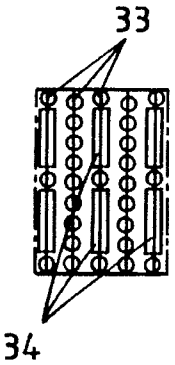
FIG. 3 shows a stretch-out of a portion of the bit seen according to the arrows III—III of FIG. 1.

In order to improve the coaxial character of the hole 2 and the core 4 further, the radially outer face 32 of the blades 8 can, by way of example, be provided according to FIG. 3 with polyhedric synthetic diamonds 33 and/or cylindrical bars 34 having generating lines which are preferably parallel to the rotation axis 6. The polyhedric diamonds 33 and the cylindrical bars 34 can advantageously be disposed in alternating rows as shown in FIG. 3, the distance between the rotation axis 6 and their ridges and/or generating lines which are the farthest removed from the rotation axis 6, being preferably equal to the distance between the other cutting edge **12*a* and the same axis 6. Other shapes of bars 34 can also be used. The diamonds 33 and especially the bars 34 are intended to stabilize the bit into the hole 2 during the coring operation and constitute wear resisting guiding pieces. Moreover, the bars 34 and especially the diamonds 33 can possibly assist in the coring operation for example in the event wherein the cutting edge 12*a*** is damaged.

In FIG. 1, said envelope curvature is extended preferably also on the other side of the top 29, in the direction of the core 4, by another curvature which is also inclined backwards as the distance to the top 29 increases. This other curvature can transform quickly in a straight line having a weak inclination. In an advantageous way, the ground cut in this way away around the core 4, during a substantially vertical coring operation, has a truncated shape enhancing the flow of coring liquid away from the core 4, in the direction of a deeper zone cut away by the cutters 10 of the top 29 and by those directly near this top. However, it can be preferred that the other curvature curves considerably towards the front of the bit, for example if there is aimed at increasing the contact between the coring liquid and the core 4 considerably.

In order to obtain a core 4 which is not altered by cutters passing too frequently, it is advantageous to provide, for example per group of blades A, B, C, a cutter **10*b* which is the nearest to the rotation axis in such a manner that it cuts the core 4 with its rounded cutting edge 12*b* and then, preferably onto the following blade 8 according to the rotation direction of the bit 1, another cutter 10*c* having another cutting edge 12*c*, parallel to the rotation axis 6, for example at the same distance from this axis as the cutting edge 12*b***.

Figure 4:
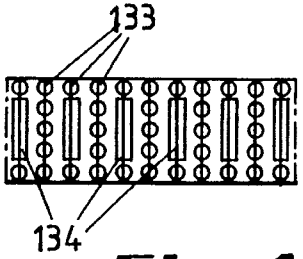
FIG. 4 shows a stretch-out of another portion of the bit seen according to the arrows IV—IV of FIG. 1.

It is also advantageous to provide around the rotation axis 6, at a determined distance from the core, a cylindrical surface 35 within the body 5 in order to attach guiding and gauging elements thereto (FIG. 4) of the type of polyhedric synthetic diamonds 133 and/or of a type of for example cylindrical bars 134 having an axis parallel to the rotation axis 6, disposed in such a manner that also their edge or generating line and/or top which are the nearest to the rotation axis 6 are at the same distance from this axis 6 as said cutting edges **12*b* and/or 12*c***.

These guiding and gauging elements can for example rectify the outer surface of the core 4 or can serve as a security in the event of damage to or wear of the cutter 10*c*, etc.

The space between the inner cylindrical surface 35 and the outer surface of the core 4 can be chosen for example as small as possible so as to avoid a reflux, towards the passage gap 21, of the coring liquid coming from the nozzles 13 and/or to increase the restriction effect realized between the annular groove 24 and the front lip 23.

Said detachment effect, obtained by disposing the nozzle 13 in a volume between two blades 8, the bottom 11 of the hole 2 and the surface 16 of the body 15 enhances considerably the evacuation of the fragments detached by the various cutters 10 and elements 33, 34, 133, 134.

It can be noticed in FIG. 1, in the plane of the section going through the rotation axis 6, that the surface of the front extremity 16 has a most forward point 301 situated in the immediate vicinity of the core 4 and determines, starting from this most forward point 301, a curve 201 which extends according to the invention progressively in a convex way towards the back of the body 5 as the distance to the rotation axis 6 increases, so as to be connected tangentially to the outer lateral surface 9. Moreover, between the most forward point 301 and the deflected outlet 15, it is advantageously provided that the curve 301 forms a recess 401 and, for example substantially at the place of the outlet 15, an embossment 402. The front side surface 16 is realized for example by rotating the so-determined curve 201 around the rotation axis 6 between the two blades 8 delimiting this surface 16. This can be done each time between two successive blades 8.

The trend of the surface 16 given by the position of the most forward point 301 enhances the evacuation of the fragments near the bit 1 and the base of the core 4, the recess 401 cooperating to this evacuation.

The geometry of the front face of the bit 1 as represented in FIG. 1 allows in a surprising way a faster coring for a same weight of the string of rods than when use is made of the usual bits. As a matter of fact, comparisons have been made between coring operations performed by means of the bit 1 such as described according to FIG. 1 and coring operations performed by means of usual bits and they have given a clear indication of a very advantageous functioning of this bit 1.

In a first case, ground formations either of the eocene or of the eocene and the paleocene, having therefore quite similar coring resistances, where concerned. For the usual bits, an average horary rate of penetration established on seven core holes comprises 7.70 m, whereas for bits 1 according to the invention, this horary average established on two holes comprises 16.18 m.

In a second case, jurassic sand formations were concerned. For other usual bits, an average horary rate of penetration established for eleven core holes comprises 4.07 m whereas for bits 1 according to the invention, with the same cutter qualities, this horary average established for two holes comprises 19.6 m.

It will be clear that the invention is in no way limited to the described embodiments and that they can be modified in many ways without leaving the scope of the present invention.

In this way, instead of cutters 10 of a cylindrical section which are shown by way of example, cubic cutters could also be used.

Moreover, for separating the coring liquid from the core, the front lip 23 can be provided for example onto the inner element 20 in such a manner that it has a zone, the inner diameter of which is practically equal to the inner diameter of the inner cylindrical surface 35.

Further, the blades 8 can be discontinuous or can be replaced for example by projections supporting the cutters 10, 10*b*, 10*c*.

Moreover, as shown by the example of FIGS. 1 and 2, the portions of the forward surface 16 contained between two successive blades 8 form with the latter nine sectors of equal angles, separated one from the other by the blades 8, such that the behaviour of the liquid and the freed debris is basically independent but equal from one sector to the other at the bottom 11 of the core hole. This structure can prevent a mixture of the liquid and the debris between two sectors forwardly of the core bit 1, and can thus avoid regrinding of the debris which is channelled between two blades 8 in order to be rapidly evacuated from the bottom 11 of the hole towards the top and out of the core hole.

I claim:

1. A core bit for obtaining a core from a reservoir, comprising:

a body which is rotatable around a rotation axis;

blades provided onto said body on a face portion of said body;

cutters along each of said blades with each of said cutters having a cutting edge;

at least one nozzle assembly which supplies a jet of coring liquid at said face portion of said body, said at least one nozzle assembly comprising an insert piece for positioning within a recess portion of said body, said insert piece defining an elbow in an outlet fluid pathway with a section of said elbow being angled less than 45° and with a section angled greater than 45° with respect to said rotation axis, said insert piece deflecting said jet of coring liquid substantially forwards with respect to said rotation axis of said body away from said core with a deflection angle larger than 45°, said insert piece having a cross-section transverse to said outlet fluid pathway defining a first circumferential portion of said outlet fluid pathway that does not fully encircle said outlet fluid pathway, said body having a bore with a cross-section transverse to said outlet fluid pathway defining a second, corresponding circumferential portion of said outlet fluid pathway.

2. The core bit according to claim 1, said inserted piece being made of a material having a higher abrasion resistance than the material of said bit.

3. The core bit according to claim 1, further comprising an inner hollow core retaining element, said inner hollow core retaining element being associated with an interior portion of said core bit so as to define a passage gap for directing a predetermined portion of said coring liquid substantially around said core, said passage gap being disposed near said cutters so as to direct coring liquid to an end portion of said core, said passage gap having a profile such that the flow rate of said coring liquid through said passage gap is smaller than 25% of a total flow rate of said coring liquid flowing through said passage gap and said at least one nozzle assembly.

4. The core bit according to claim 3, characterized in that the flow rate of said coring through said passage gap is equal to or smaller than 5% of said total flow rate.

5. The core bit according to claim 1, comprising an inner hollow element positioned within said body, said inner hollow element being cylindrical and having a substantially axial annular front lip, said body having an annular groove wherein said front lip projects substantially coaxially to form a passage gap between said annular front lip and said annular groove for directing a portion of said coring liquid around said core.

6. The core bit according to claim 5, characterized in that said front lip is connected to said inner hollow core retaining element in such a manner that an annular collar is formed, said annular collar being situated on the inside of said inner hollow core retaining element and faceing an inner edge of said annular groove.

7. The core bit according to claim 6, characterized in that a passage distance, parallel to said rotation axis, between a front extremity of said front lip and a bottom of said annular groove is smaller than 12 mm but is at least equal to 5 mm.

8. The core bit according to claim 1, said cutters being mounted to said blades such that rotation of said body about said rotation axis forms an envelope defined by an outline of said cutters, a cross-section of said envelope in a plane including said rotation axis having a top in the forward direction and a curvature that extends away from said top in the direction opposite said rotation axis, said curvature being only slightly inclined adjacent said top.

9. The core bit according to claim 8, characterized in that said curvature becomes more inclined with distance radially outwardly from said top until said envelope is substantially parallel to said axis of rotation.

10. The core bit according to claim 8, characterized in that said envelope comprises in said plane including said rotation axis a backwards inclination which extends inwardly away from said top towards said rotation axis.

11. The core bit according to claim 1, characterized in that a cutter which is farthest removed from said rotation axis has a cutting edge that is substantially parallel to said rotation axis.

12. The core bit according to claim 1, characterized in that a cutter which is situated the nearest to said rotation axis has a cutting edge which is substantially parallel to said rotation axis.

13. The core bit according to claim 1, characterized in that it comprises an inner cylindrical surface for engaging said core, said inner cylindrical surface having thereon at least one guide element with a spherical surface.

14. A method for making a coring assembly to obtain a core from a formation, comprising the following steps:

providing a hollow region within said coring assembly for receiving said core;

providing cutting elements on an end region of said coring assembly for cutting into said formation;

providing a fluid passageway within said coring assembly for directing coring fluid to said end region of said coring assembly;

providing an insert within said fluid passageway on said end region of said coring assembly for directing said coring fluid radially outwardly, said insert not fully encircling said fluid passageway; and providing said fluid passageway within said coring assembly with a desired diameter connection to said hollow region for controlling coring fluid flow to said core in the region of said cutting elements.

15. The method of claim 14, further comprising:

adjusting said desired diameter of said connection to limit coring fluid flow to said core to less than 25% of total coring fluid flow.

16. A core bit to obtain a core from a formation, comprising:

a body section having a bore therethrough and being rotatable about a rotation axis that extends through said bore, said body section having a face region;

a plurality of cutters disposed on said face region of said body section for cutting into said formation;

a plurality of nozzles to supply coring liquid at said face region of said body section, each of said nozzles directing said coring liquid radially outwardly from said core to wash particles of said formation that have been cut in a radially outwardly direction;

a hollow retaining element disposed within said bore of said body section, said hollow retaining element and said body section defining a flow passageway for supplying said plurality of nozzles with coring liquid and for supplying coring fluid around said core, said flow passageway being sized such that greater than 75% of said coring liquid is supplied to said plurality of nozzles; and an insert piece for each of said plurality of nozzles having a curved portion therein positioned for directing said coring liquid radially outwardly, said curved portion of said insert piece not fully encircling said coring liquid that flows through said plurality of nozzles.

* * * * *